United States Patent [19]

Benatar

[11] 4,286,774

[45] Sep. 1, 1981

[54] SYSTEM FOR AUTOMATICALLY INJECTING A MEASURED QUANTITY OF POWDERED REAGENT INTO A POOL OF MOLTEN METAL

[76] Inventor: Victor Benatar, 1191 Hopkins Ter., Atlanta, Ga. 30324

[21] Appl. No.: 142,648

[22] Filed: Apr. 22, 1980

[51] Int. Cl.[3] ..... C21B 5/02

[52] U.S. Cl. ..... 266/82; 75/60; 266/216

[58] Field of Search ..... 266/82, 216; 75/60

[56] References Cited

U.S. PATENT DOCUMENTS

| | | | |
|---|---|---|---|
| 1,598,128 | 8/1926 | Gase | 177/72 |
| 3,689,045 | 9/1972 | Coulter | 266/82 |
| 3,929,464 | 12/1976 | Todd | 266/216 |
| 3,955,966 | 5/1972 | Meichsner | 75/53 |
| 4,197,116 | 4/1980 | Kolb | 75/60 |
| 4,212,331 | 7/1980 | Benatar | 141/67 |

*Primary Examiner*—P. D. Rosenberg
*Attorney, Agent, or Firm*—Rodgers & Rodgers

[57] ABSTRACT

A system for automatically controlling the injection of powdered reagent into a pool of molten metal through a generally vertically disposed movable tubular lance includes lance manipulating means for imparting movement to the lance, convey gas control means operable in coordination with movement of the lance toward the pool of molten metal for initiating the flow of convey gas through the lance, common control means actuated in coordination with continued movement of the lance toward the pool of molten metal and effective to arrest downward movement of the lance and to initiate the flow of powdered reagent from a dispenser vessel through the lance and into the molten metal when the outlet end of the lance reaches a predetermined level, and measuring control means for sensing the injection of a predetermined quantity of powdered reagent into the molten metal for activating the common control means and thereby to cut off the flow of powdered reagent through the lance and to activate said lance manipulating means so as to lift the lance out of the molten metal and into a parked inactive position.

11 Claims, 5 Drawing Figures

Fig. 4
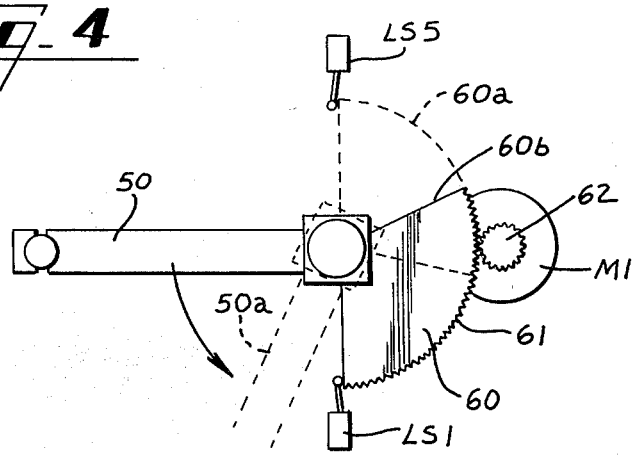
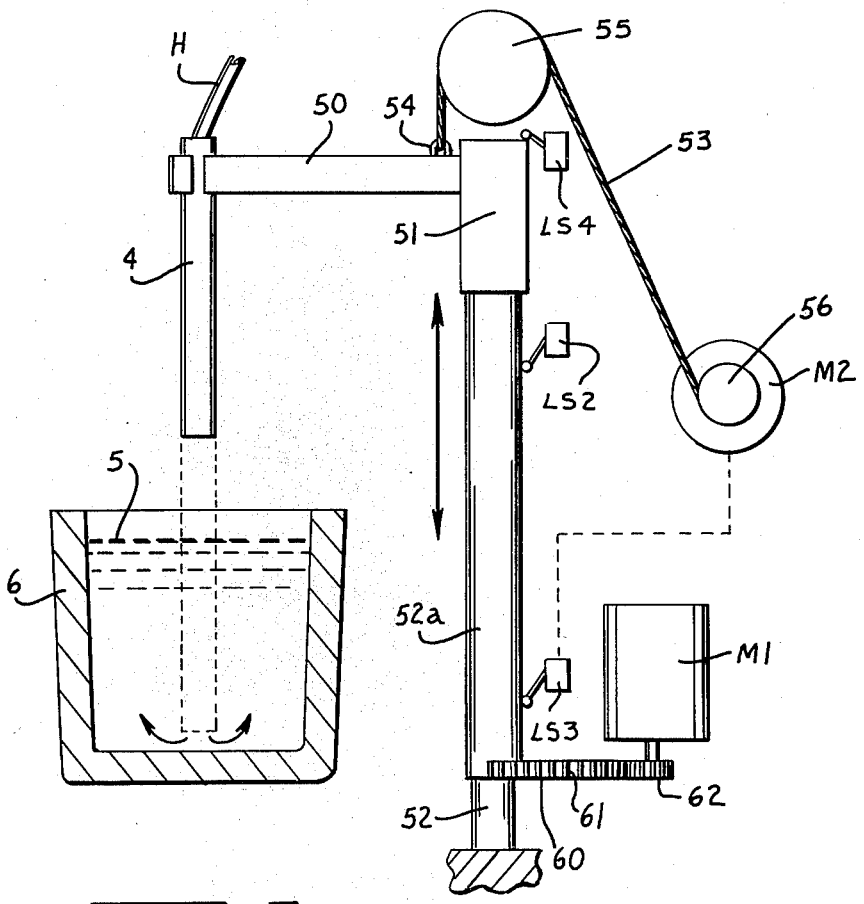
Fig. 3

SYSTEM FOR AUTOMATICALLY INJECTING A MEASURED QUANTITY OF POWDERED REAGENT INTO A POOL OF MOLTEN METAL

TECHNICAL FIELD

Finely powdered material such as calcium carbide or magnesium is supplied to molten ferrous metal in order to effect a desulphurizing action as is explained in U.S. Pat. No. 3,929,464 issued Dec. 30, 1975 and titled "Desulphurization of Molten Ferrous Metals".

BACKGROUND ART

Known apparatus for injecting powdered reagent into molten metal requires close attention of one or more operators. For example, the dispensation of a predetermined quantity of powdered reagent is measured and its quantity determined by the operator by means of visual observation of measuring devices and suitable control operations are then initiated manually by the operator. Such operations not only require the expense of an operator but are subject to human error and frequently result in costly down time and wastage of reagent and energy because improperly desulphurized metal must be reprocessed.

One known system of weighing material is disclosed in U.S. Pat. No. 1,598,128 and apparatus for discharging powdered reagent from a shipping container into a dispensing vessel is disclosed and claimed in U.S. application Ser. No. 965,400 filed Dec. 1, 1978 now U.S. Pat. No. 4,212,331.

DISCLOSURE OF THE INVENTION

According to this invention in one form, injection of a predetermined quantity of powdered reagent into a pool of molten ferrous metal of predetermined quantity is performed automatically once a start button is pushed to initiate a cycle including movement of a generally vertically oriented lance disposed above the pool of molten metal toward the pool of metal, the initiation of the flow of convey gas, continued downward movement of the lance being effective to actuate common control means which is operable to arrest downward movement of the lance and to initiate the flow of powdered reagent from a dispenser vessel through the lance and into the molten metal when the outlet end of the lance reaches a predetermined level together with measuring control means for sensing the injection of a predetermined quantity of powdered reagent into the molten metal and for thereafter activating the common control means thereby to cut off the flow of powdered reagent through the lance and to activate the lance manipulating means so as to lift the lance out of the molten metal and then to shut off the flow of convey gas and to park the lance in its starting position.

BRIEF DESCRIPTION OF THE DRAWINGS

In the drawings:

FIG. 3 is a schematic view of a portion of the apparatus shown in FIG. 1 and which includes the mechanism for manipulating the lance into and out of a pool of molten metal;

FIG. 4 is a plan view from above of a portion of FIG. 3; and

BEST MODE OF CARRYING OUT THE INVENTION

Figure 1:
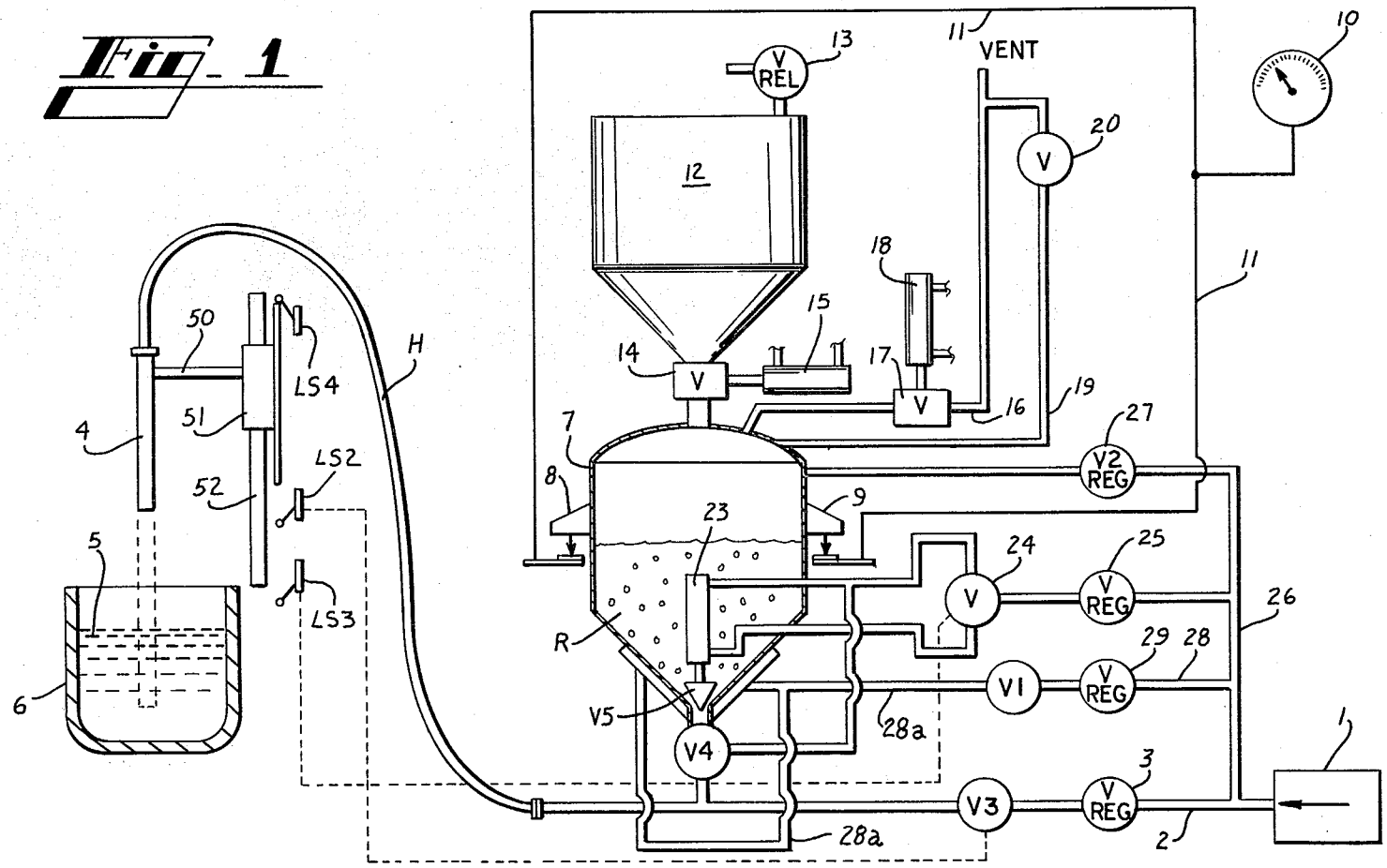
FIG. 1 is an overall schematic view of a system for injecting powdered reagent into a pool of molten metal.

With reference to FIG. 1 the numeral 1 designates a reservoir of convey gas which is under pressure. Gas from tank 1 is supplied through conduit 2, regulating valve 3 and control valve V3, and flexible hose H and finally through lance 4. After the lance 4 is manipulated to its lowermost position into molten metal 5 in container 6 as indicated by dotted lines in FIGS. 1 and 3, powdered reagent R is supplied through opened valves V4 and V5 from dispensing container 7 into the conduit 2 through which convey gas is flowing. By this means the reagent R is supplied through the lance 4 and into the pool 5 of molten metal in container 6. The quantity of reagent R at any given moment which is contained in dispensing tank 7 is indicated by schematically shown weight supporting elements 8 and 9 and indicating device 10 which is interconnected with the weight supporting and indicating mechanisms 8 and 9 by conduits 11.

Thus with a given starting weight as indicated by device 10, a given quantity of powdered reagent dispensed into the molten metal 5 is indicated by device 10 at which time the flow of reagent R is cut off by simply closing valves V4 and V5. Thereafter the lance 4 is elevated to a level at which its lower end is above the surface of molten metal 5 at which point convey gas is shut off by closing control valve V3. The lance 4 is then elevated and moved to a parking position of readiness to begin a new cycle of operation.

A conventional shipping container 12 with a relief valve 13 is mounted atop the dispensing vessel 7 which has a filling valve 14 controlled by pneumatic operating device 15 in conventional fashion.

For the purpose of venting dispensing vessel 7 to atmosphere, a conduit 16 and valve 17 controlled by pneumatic mechanism 18 is provided together with conduit 19 controlled by throttle valve 20. Operation of valve V5 is by means of mechanism 23 controlled by valve 24 supplied with pressure gas through regulating valve 25 and conduits 26 and 2 from tank 1.

The interior of dispensing tank 7 is pressurized by gas supplied through regulating valve 27 from conduits 26 and 2 from tank 1. Powder within tank 7 is aerated or fluidized by gas through conduits 28, 28*a* and through regulating valve 29 and valve V1.

Figure 2:
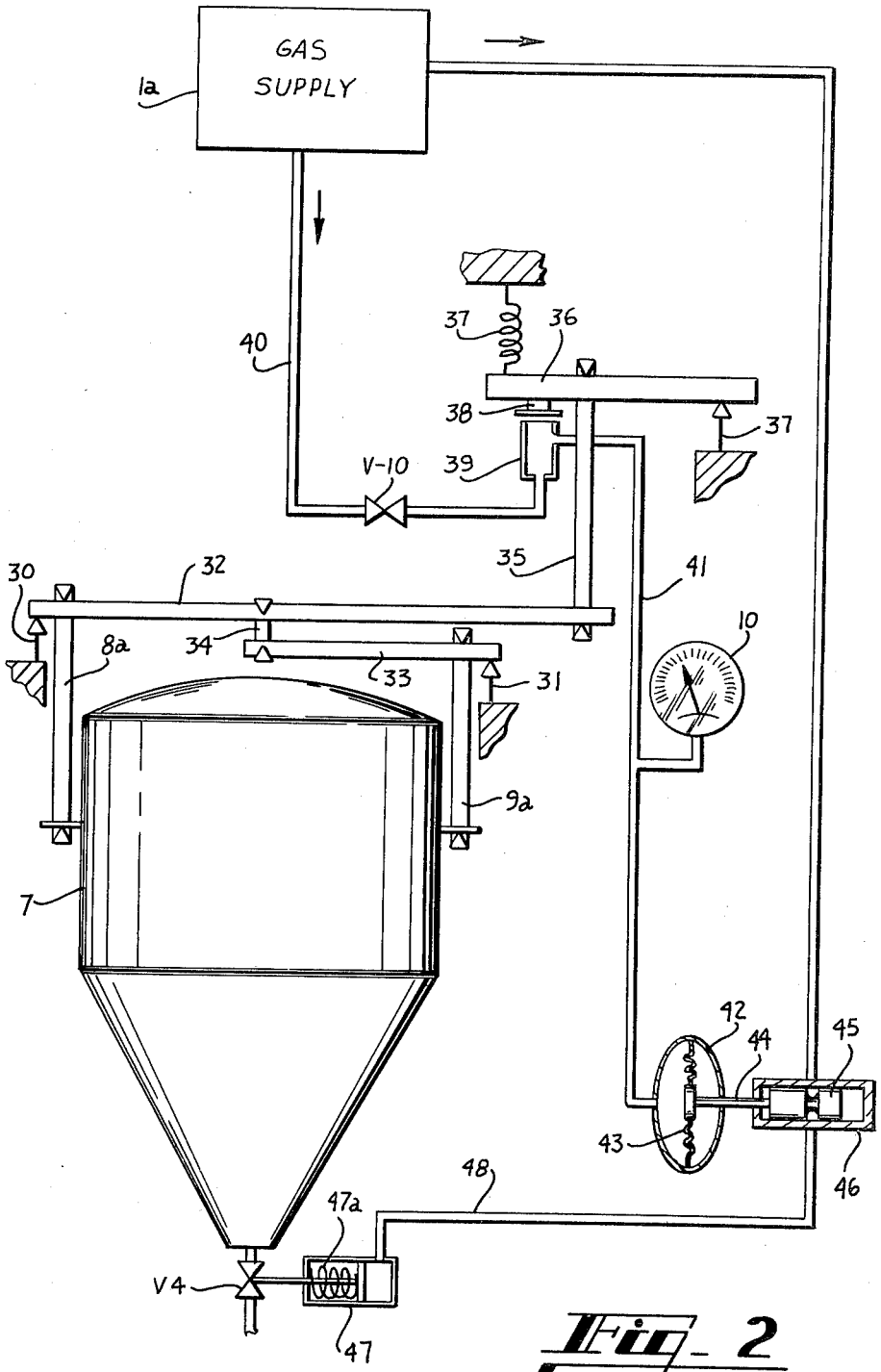
FIG. 2 is a schematic representation of a weighing system shown schematically in FIG. 1 and which determines the amount of powdered reagent used from the start of an injecting operation to the completion thereof and which then shuts off the flow of powdered reagent.

The weighing system schematically represented at 8, 9, 10 and 11 in FIG. 1 is more fully represented schematically in FIG. 2. As is apparent in FIG. 2 rods 8*a*, 9*a* and fixed supports 30 and 31 together with levers 32 and 33 as well as connector 34 serve to transmit the weight of dispenser 7 and parts associated therewith including its contents through a pull rod 35 to a weigh beam 36 which is supported by fixed support 37 at its right hand end and which is biased upwardly at its left hand end by tare weight spring 37. Thus variations in the weight of dispenser 7 are reflected by up and down movement of the left hand end of weigh beam 36 which imparts vertical movement to pressure chamber cap 38. A constant amount of gas flows from gas supply 1*a* to chamber 39 as regulated by throttle valve V-10. Chamber cap 38 is held down on chamber 39 by the force of pull rod 35. When the pressure in chamber 39 becomes great enough, it raises cap 38 slightly to allow an amount of gas to escape equal to the amount bled into the chamber 39. This pressure is proportional to the pull rod force and this pressure is transmitted through conduit 41 to pressure responsive operating device 42 which is provided with a diaphragm 43 together with an operating rod 44 connected at its right hand end with a movable internal valve element 45 of relay 46 thereby to supply pressure gas to valve operating device 47 through conduit 48. Valve V4 is opened by operating device 47 against the bias of spring 47*a* which effects closure of valve V4 so that start of a dispensing operation occurs when the pressure in conduit 41 is above a predetermined level. Valve V4 closes under the action of spring 47*a* when pneumatic relay 46 is closed and pressure in conduit 48 is reduced.

Of course, weighing may be accomplished by an equivalent electrical load cell system arranged to operate a solenoid on valve V-4 to accomplish a similar operation of regulating the amount of powdered reagent dispensed.

The lance manipulating mechanism shown schematically in FIG. 1 is shown schematically in more detail in FIG. 3. From FIG. 3, it is apparent that the lance 4 is supported by an arm 50 secured at its right hand end to a collar 51 which is swivelled on and slidable vertically on post 52 which is fixed in position relative to container 6. Up and down movement of lance 4 and of arm 50 and collar 51 is imparted by cable 53 which is secured at 54 to arm 50 and which rides over pulley 55. Cable 53 is wound on winch 56 secured to the shaft of motor M2. Thus operation of motor M2 in one direction such as clockwise effects a lowering operation of the lance 4 while rotation of motor M2 in a counterclockwise direction raises the lance 4. Flexible hose conduit H accommodates movement of lance 4.

Once the lance 4 and associated mechanism is moved upwardly to its uppermost position as represented in FIGS. 1 and 3, it is swung horizontally to the position indicated by dotted lines at 50A in FIG. 4. This horizontal swinging movement of arm 50 of a lance 4 about the post 52 as a center is effected by segment 60 which is rigidly affixed in position on sleeve 52*a* which is swivelled on post 52 and secured to arm 50 and which is provided with an arcuate toothed portion 61 for cooperating with pinion 62 mounted on the shaft of motor M1 so that operation of motor M1 in a clockwise direction as viewed in the plan view of FIG. 4 imparts counterclockwise swinging movement to arm 50 from the position indicated at 50 in solid lines to the position indicated at 50A in dotted lines. Of course rotation of motor M1 in a counterclockwise direction causes reverse movement of arm 50 from the position indicated in dotted lines at 50A to the position indicated in solid lines at 50.

Figure 5:
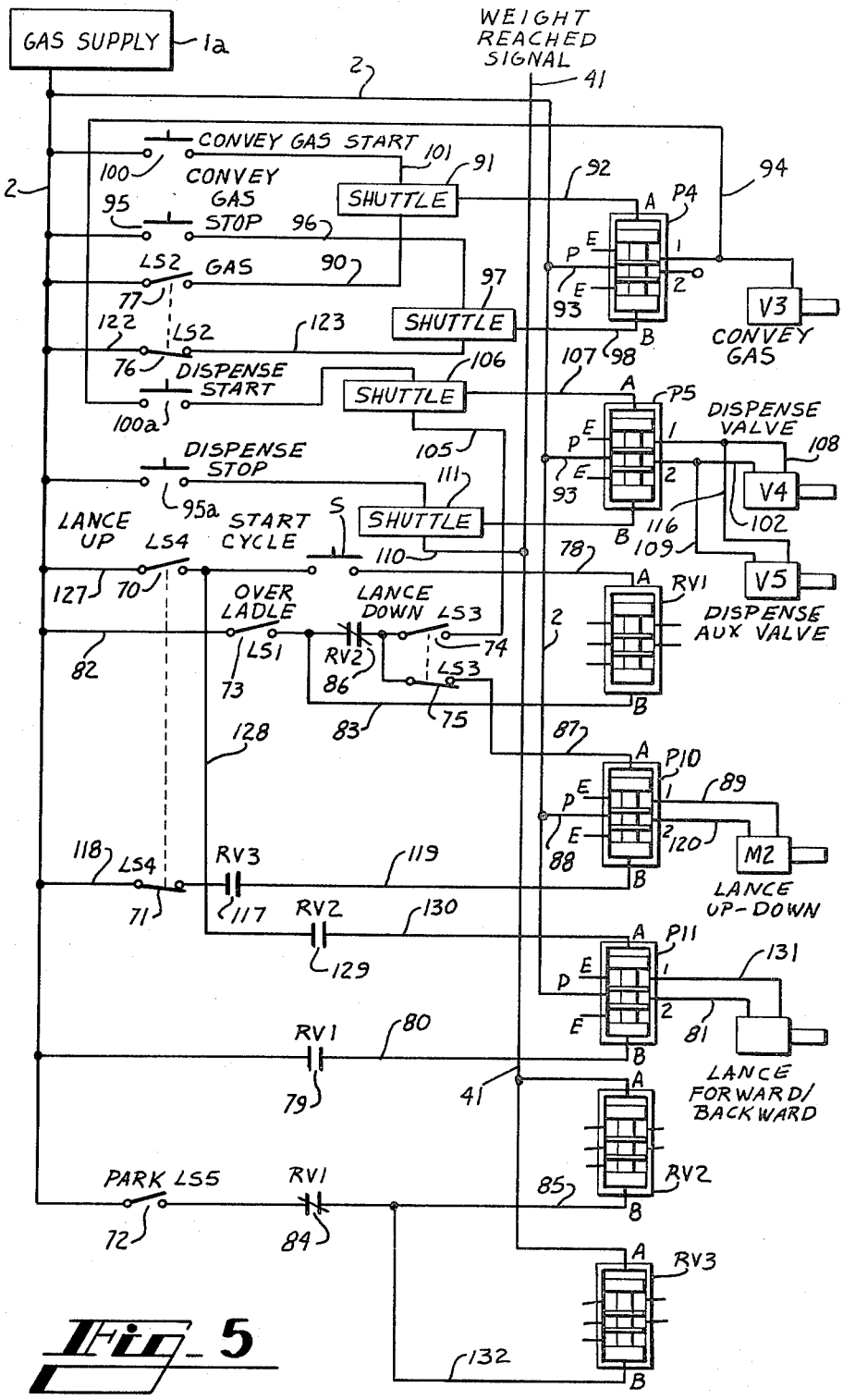
FIG. 5 is a schematic overall one line diagram which depicts the pneumatic control system arranged according to this invention.

Automatic control of the system is effected primarily by a system of common control means including devices designated LS1–LS5 which are indicated schematically in FIGS. 3, 4 and 5. In FIG. 5, gas conduits are indicated schematically by one line diagrams and the passages for relays RV-1, RV-2 and RV-3 are shown removed from the relay operators for the sake of simplicity and clarity.

At the start of a cycle, the system is in a condition of readiness to begin movement from the position of the lance indicated at 50A in FIG. 4 horizontally to the position indicated at 50 and then downwardly into the molten metal 5 and upwardly to the position indicated at 50 and then horizontally to the position indicated at 50A. With reference to FIG. 5 and at the start of a cycle, conduit 2 is pressurized and one passage 70 to LS4 is passing while the other passage 71 of LS4 is non-passing. Passage 72 of LS5 is passing and passage 73 of LS1 is non-passing as is passage 74 of LS3. Passage 75 of LS3 is passing. Passage 76 of LS2 is passing while passage 77 of LS2 is non-passing.

The cycle is started by manually closing the start valve S. This establishes a flow of gas under pressure from conduit 2 through passage 70, and conduit 78 to the "A" port of relay RV-1 since passage 70 of LS4 is passing. This action causes passage 79 of relay RV-1 to become passing and allows pressure to flow through conduit 80 to the "B" port of spring centered valve P-11. This action applies pressure gas through conduit 81 to motor M1 and drives that motor in a counterclockwise direction as viewed in FIG. 4 so as to swing the segment gear 60 and the arm 50 and lance 4 in a clockwise direction from the dotted line position indicated at 50A to the solid line position indicated at 50.

At such time as the segment 60 engages the operating element of device LS1, operator 73 of that device is passing and establishes a flow of pressure gas through conduits 82 and 83 to the "B" port of relay RV-1. This operation establishes a passing condition at passageway 84 of relay RV-1 and a non-passing condition to passageway 79 of relay RV1. When this passageway 79 becomes non-passing, the spring centered valve P-11 goes to the center position, thereby stopping motion of M1. Passageway 86 of RV2 and 75 of LS3 are passing so that pressure is applied to port A of P10 through conduits 82 and 87. This operation supplies pressure gas from conduits 2, 88 and 89 to motor M2 and by this means starts the downward movement of the lance 4 due to clockwise rotation of motor M2.

At such time as the lower part of collar 51 engages the operating arm of LS2, passageway 77 of LS2 is passing and passageway 76 of LS2 is non-passing. This action establishes a flow of gas from conduit 2 through conduit 90 shutttle 91, and conduit 92 to the "A" port of valve P-4. This action establishes a passageway from conduit 2 to conduit 93 and valve P-4 and conduit 94 to convey gas valve V3 and initiates the flow of convey gas from tank 1 through conduit 2, hose H and lance 4. This action is initiated before the lower end of lance 4 reaches the upper surface of molten metal 5.

The convey gas could be stopped manually by closing the manually operable device 95 to cause pressure to be supplied through conduit 96 and shuttle 97 as well as conduit 98 to the "B" port of valve P4. In like fashion the convey gas could be initiated manually rather than automatically as described above by manual means through the agency of manually operable device 100, conduit 101, shuttle 91, conduit 92 to the "A" port of valve P4 and sent through conduit 94 to operate valve V3 and thus to start the gas. Of course this manual control by virtue of devices 95 and 100 is an alternate system which if need be may be employed but which ordinarily is not used under automatic operating conditions.

Continued downward movement of the lance to its lowermost position with its lower end near the bottom of container 6 causes the lower edge of collar 51 to engage the operating arm of operating device LS3. This operation makes the passage 74 of device LS3 passing and the passage 75 non-passing. Making passage 74 passing establishes a flow pressure fluid from conduits 2, 82, open passageway 73 of LS1, passageways 86 and 74 to conduit 105 through shuttle 106 and conduit 107 to the "A" port of valve P-5. This action opens the passageway to conduits 108 and 116 so as to open the dispense valve V4 and the auxiliary dispense valve V5. Of course this action initiates the flow of powdered reagent R from dispensing container 7 through conduit 2 and flexible hose H and lance 4 into the molten metal 5. The flow of powdered reagent can be controlled by means of the manual start device 100*a* and by the manual stop device 95*a* in conjunction with conventional shuttles 106 and 111 respectively as is well known, these shuttles comprise a single output and alternate inputs controlled by an internal valve element.

Actuation of LS3 makes the passage 75 non-passing which shuts off the flow of gas through conduit 87 to port "A" of valve P-10 and arrests the downward movement of the lance due to stoppage of operation of motor M2. During this condition, convey gas is flowing downwardly through the lance 4 and powdered reagent is supplied to the molten metal 5 to effect desulphurization thereof.

After the desired quantity of reagent is dispensed into the molten metal 5, a signal from the measuring control means applies a signal through conduit 41 through conduit 110 and shuttle 111 to the "B" port of valve P5. This action applies pressure through conduits 102 and 109 to close the dispensing valve V4 and the auxiliary dispensing valve V5. Of course this action stops the flow of powdered reagent.

Simultaneously with the stoppage of the flow of powdered reagent, the lance is moved upwardly due to the fact that pressure gas in conduit 41 is supplied to the "A" port of relay RV-3. This action actuates that relay so as to make the passageway 117 of relay RV-3 passing and thereby to allow pressure gas from conduit 2 to flow through passageway 71 of LS2 through conduits 118, 119 to the "B" port of valve P-10. This action supplies pressure fluid from conduit 2, conduit 88 and conduit 120 to the motor M2 to start the upward movement of lance 4 by driving the motor M2 in a counterclockwise direction as viewed in FIG. 3.

Upward movement of the lance continues and the flow of convey gas also continues until the lower end of the lance 4 reaches a point above the surface of the molten metal 5. Thereafter the upper end of collar 51 releases the operating arm of LS2 to make the passage 76 of LS2 passing and establishes a passage from conduit 2, conduit 122, passage 76, conduit 123, shuttle 97, and conduit 98 to the "B" port of valve P-4. This action shuts off the flow of convey gas by closing valve V3.

Continued upward movement of the lance results in the engagement of the upper surface of collar 51 with the operating arm of LS4. This makes passageway 71 non-passing so as to cut off pressure to the "B" port of valve P-10 and effectively closes valve P-10 and stops motor M2 thereby to arrest upward movement of the lance 4. Simultaneously passageway 70 is made passing to establish a flow of gas from conduit 2 through conduits 127, 128, passageway 129 through relay RV-2, conduit 130 to the "A" port of valve P-11. This action applies pressure to conduit 131 and by this means drives the motor M1 in a backward direction from the position of arm 50 indicated in solid lines and toward the position indicated in dotted lines at 50A.

Swinging movement of the arm 50 and the segment 60 to the positions 50A and 60A results in engagement of the edge 60B of segment 60 with the operating arm of LS5. This action causes the operator 72 of LS5 to move to a passing position and in so doing applies pressure through conduit 85 and the closed passage 84 of RV-1 to the "B" port of relay RV-2. This action causes the passageway 129 of RV-2 to become non-passing and thus allows the movable element of valve P11 to move to a neutral position at which no pressure is supplied through the open RV-2 and P11 to the motor M1 so that the swinging movement of arm 50 is arrested. The lance is then in parked position with LS5 closed and with the convey gas shut off as is the powdered reagent. In this condition the apparatus is ready for the start of a new cycle which as explained is initiated by means of the start element S.

While the system as described is of the pneumatic type it is obvious that an equivalent electrical system could be used if desired.

INDUSTRIAL APPLICABILITY

This invention is well suited for automating known systems which are manually controlled and which dispense powdered reagent into molten metal for the purpose of desulphurization.

What is claimed is:

1. A system for automatically controlling the injection of powdered reagent from a dispenser vessel into a pool of molten metal through a conduit interconnected with said dispenser vessel and with a generally vertically disposed movable tubular lance, said system comprising lance manipulating means for imparting movement to said lance, a convey gas reservoir interconnected with said conduit valve means in said conduit and operable in coordination with movement of the lance toward said pool of molten metal and actuated by convey gas control means which is engageable by a part movable with said lance to initiate the flow of convey gas through said conduit and lance, common control means for controlling the flow of powdered reagent into said conduit and for controlling movement of the lance and actuated in coordination with continued movement of the lance toward the pool of molten metal and effective to arrest such movement of the lance and to initiate the flow of powdered reagent from said dispenser vessel through the lance and into the molten metal when the lance reaches a predetermined level, and measuring control means responsive to reduction in weight of said dispenser vessel and of powdered reagent therein for sensing the injection of a predetermined quantity of powdered reagent into said molten metal for activating said common control means and thereby to cut off the flow of powdered reagent through the lance and to activate said lance manipulating means so as to lift the lance out of the molten metal.

2. A system according to claim 1 wherein upward movement of the lance to a level such that its outlet end is above the surface of the molten metal actuates said convey gas control means so as to shut off the flow of convey gas through said lance.

3. A system according to claim 2 wherein said lance manipulating means imparts upward movement to the lance to its uppermost position and thereafter initiates substantially horizontal movement thereof to a parking position.

4. A system according to claim 3 wherein arresting control means engageable by a part of said lance manipulating means deactivates said lance manipulating means.

5. A system according to claim 1 wherein said lance manipulating means imparts substantially horizontal movement to the lance from a starting position to an aligned position above the molten metal and thereafter imparts downward movement to the lance in response to a control signal.

6. A system according to claim 1 wherein said powdered reagent is supplied to said lance by a flexible conduit from said dispenser vessel.

7. A system according to claim 6 wherein said dispenser vessel is pressurized with an inert gas at a predetermined pressure.

8. A system according to claim 6 wherein said powdered reagent is fluidized by aeration gas dispensed through at least a portion of said powdered reagent.

9. A system according to claim 7 wherein said dispenser vessel is vented and wherein aeration gas is dispensed through at least a portion of said powdered reagent at a pressure in excess of said predetermined pressure.

10. A system according to claim 1 wherein said dispenser vessel is pressurized with an inert gas at a predetermined pressure which is greater than the pressure of said conduit means.

11. A system according to claim 1 wherein interlock means responsive to cessation of flow of convey gas is arranged to render said common control means ineffective to control the supply of powdered reagent from said dispenser vessel.

* * * * *